US009970333B2

(12) United States Patent
Welte et al.

(10) Patent No.: US 9,970,333 B2
(45) Date of Patent: May 15, 2018

(54) CAM SHAFT PHASE SETTER COMPRISING A CONTROL VALVE FOR HYDRAULICALLY ADJUSTING THE PHASE POSITION OF A CAM SHAFT

(71) Applicant: Schwäbische Hüttenwerke Automotive GmbH, Aalen-Wasseralfingen (DE)

(72) Inventors: Claus Welte, Aulendorf (DE); Uwe Meinig, Bad Saulgau (DE); Juergen Bohner, Bad Waldsee (DE)

(73) Assignee: Schwabische Huttenwerke Automotive GmbH, Aalen-Wasseralfingen (DE)

( * ) Notice: Subject to any disclaimer, the term of this patent is extended or adjusted under 35 U.S.C. 154(b) by 417 days.

(21) Appl. No.: 14/702,953

(22) Filed: May 4, 2015

(65) Prior Publication Data

US 2015/0233269 A1 Aug. 20, 2015

Related U.S. Application Data

(63) Continuation of application No. 13/044,013, filed on Mar. 9, 2011, now Pat. No. 9,021,997.

(30) Foreign Application Priority Data

Mar. 9, 2010 (DE) ..... 10 2010 002 713

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/3445* (2013.01);
(Continued)

(58) Field of Classification Search
CPC ..... F01L 1/3442; F01L 2001/34426; F01L 2001/3445; F01L 2001/34446; F01L 2001/3443; F01L 2001/34433
(Continued)

(56) References Cited

U.S. PATENT DOCUMENTS 5,228,417 A 7/1993 Hara
6,182,622 B1 2/2001 Goloyatai-Schmidt
(Continued)

FOREIGN PATENT DOCUMENTS

DE 196 54 926 C2 11/1997
DE 198 48 706 A1 4/2000
(Continued)

OTHER PUBLICATIONS

Page from Office Action of DE 10 2010 002 713.8 citing reference DE 10 2004 025 215 A1.
(Continued)

*Primary Examiner* — Zelalem Eshete
(74) *Attorney, Agent, or Firm* — RatnerPrestia

(57) ABSTRACT

A cam shaft phase setter for adjusting the rotational angular position of a cam shaft relative to a crankshaft of an internal combustion engine by means of a hydraulic fluid, the cam shaft phase setter including a stator which can be rotary-driven by the crankshaft; a pressure chamber for the fluid; a rotor which is connected, rotationally fixed, to the cam shaft and coupled to the stator such that torque is transmitted and which can be adjusted in its rotational angle relative to the stator by introducing the fluid into the pressure chamber; a control valve including a valve housing and a valve piston; the valve housing including a housing inlet, an operating port to the pressure chamber and a reservoir port to a reservoir for the fluid and being connected, rotationally fixed, to the cam shaft or being formed by the cam shaft; the
(Continued)

valve piston being axially adjustable back and forth in the valve housing between a first position and a second position and including a piston feed which is connected to the housing inlet and is connected to the operating port in the first position of the valve piston and separated from the operating port in the second position of the valve piston; an actuating unit, coupled to the valve piston, for axially adjusting the valve piston; and a feedback through which fluid which flows through the valve housing can be fed back into an engine housing of the internal combustion engine which rotatably mounts the cam shaft; wherein the cam shaft phase setter is configured such that the fluid flowing through the control valve flows back into the engine housing through one or more components of the phase setter which rotate with the cam shaft.

20 Claims, 5 Drawing Sheets

(52) U.S. Cl.
CPC ..... *F01L 2001/34426* (2013.01); *F01L 2001/34433* (2013.01); *F01L 2001/34446* (2013.01)

(58) Field of Classification Search
USPC ..... 123/90.17
See application file for complete search history.

(56) References Cited

U.S. PATENT DOCUMENTS

| | | | |
|---|---|---|---|
| 7,025,023 | B2 | 4/2006 | Lehmann et al. |
| 7,243,626 | B2 | 7/2007 | Strauss et al. |
| 7,556,000 | B2 | 7/2009 | Pierik et al. |
| 2005/0016479 | A1 | 1/2005 | Tawa et al. |
| 2007/0023722 | A1 | 2/2007 | Oishi |
| 2007/0169730 | A1 | 7/2007 | Kohrs et al. |
| 2009/0159829 | A1 | 6/2009 | Hoppe et al. |

FOREIGN PATENT DOCUMENTS

| | | | |
|---|---|---|---|
| DE | 199 55 507 | C2 | 6/2001 |
| DE | 103 22 394 | A1 | 12/2004 |
| DE | 103 46 443 | A1 | 5/2005 |
| DE | 10 2004 025 215 | A1 | 12/2005 |

OTHER PUBLICATIONS

Non-Final Office Action for U.S. Appl. No. 14/970,937, dated Sep. 20, 2017, 16 pages.
Final Office Action for U.S. Appl. No. 14/970,937, dated Feb. 14, 2018, 12 pages.

CAM SHAFT PHASE SETTER COMPRISING A CONTROL VALVE FOR HYDRAULICALLY ADJUSTING THE PHASE POSITION OF A CAM SHAFT

CROSS REFERENCE TO RELATED APPLICATIONS

This application is a Continuation of U.S. patent application Ser. No. 13/044,013, filed Mar. 9, 2011 which claims priority to German Patent Application No. 10 2010 002 713.8, filed on Mar. 9, 2010, the contents of which are incorporated herein by reference.

FIELD OF THE INVENTION

The invention relates to a cam shaft phase setter comprising a control valve for hydraulically adjusting the phase position of a cam shaft relative to a crankshaft of an internal combustion engine. The invention relates to the cam shaft phase setter itself and also to an internal combustion engine with the cam shaft phase setter mounted. The internal combustion engine can in particular be a drive motor for or in a motor vehicle.

BACKGROUND OF THE INVENTION

In order to increase output and torque, but also in order to reduce the fuel consumption and exhaust emissions of internal combustion engines for road vehicles, cam shaft phase setters for varying the inlet or outlet control times have become widespread. Hydraulic phase setters which can be operated using engine oil in accordance with the principle of the hydraulic pivoting motor have established themselves in terms of high reliability and a good cost-benefit ratio. Hydraulically operable cam shaft phase setters in which a control valve for controlling the application of pressure to pressure chambers which serve to adjust the phase position, and an electromagnet which serves to operate the control valve, are arranged centrally on the rotational axis of the cam shaft have become widespread, not least from a point of view of cost. Since the installation space available is only limited, and due to cost pressure and the large channel cross-sections in the oil feed which are required for rapid adjustment, solutions in which the pressure oil to the phase setter, which rotates together with the cam shaft, is fed via a channel, provided in the cam shaft, to the control valve which is likewise arranged centrally have proven advantageous. The pressure oil is fed to the rotating cam shaft from the cylinder head, typically via one of the cam shaft bearings, preferably a pivot bearing of the cam shaft. The invention relates to phase setters of the described type in particular.

The control valve is favourably arranged and configured such that the characteristic curve of the valve is independent of the pressure of the oil. Otherwise, the setting of intermediate positions in the phase position of the cam shaft would for example be made more difficult or even prevented. It is therefore desirable if no resultant axial forces or only negligibly small resultant axial forces can be exerted on the valve piston of the control valve by the pressure oil, despite the changing pressure during operation of the internal combustion engine, so as not to disrupt the equilibrium of forces between the electromagnet acting on the valve piston and a valve spring which usually counteracts the electromagnet.

In order to avoid the resultant axial thrust, phase setters which rotate with the cam shaft and are supplied with the pressure oil via the cam shaft are usually supplied with the pressure oil via feeds which are directed towards the valve piston radially from without. Phase setters of this type are disclosed for example in DE 199 55 507 C2, DE 103 46 443 A1 and DE 196 54 926 C2. However, applying the pressure oil in this way entails channel guides which are expensive to produce, in particular P-type conduction. It is also difficult to configure the channels with large channel cross-sections, which are favourable for high adjusting speeds.

In order to avoid the problems described, cam shaft phase setters are known—for example from DE 198 48 706 A1 and DE 103 22 394 A1—in which the central control valve is arranged such that it cannot be rotated relative to an engine housing of the internal combustion engine, such that the cam shaft rotates relative to the control valve. The different oil feeds and oil drains to and from the control valve are separated from each other by means of shaft sealing rings, which however causes increased design expense and significant additional costs, resulting for instance in increased demands on the tolerances for the components which determine the radial position of the control valve relative to the cam shaft.

An additional problem known from the cited prior art is caused by arranging the coil of the electromagnet such that it is rotationally fixed relative to the engine housing of the internal combustion engine, as is preferred, while the anchor of the electromagnet is connected, rotationally fixed, to the valve piston of the control valve. The rotating anchor exhibits a practically unavoidable radial offset with respect to the coil, which causes radial forces which act on the anchor and thus on the valve piston and have to be absorbed by the tribological pairing of the valve housing and the valve piston. This in turn makes it more difficult to fulfil the requirement for a minimum possible hysteresis of the characteristic curve of the valve and increases the wear on the sliding areas of the tribological pairing.

SUMMARY OF THE INVENTION

It is an object of the invention to provide a cost-effective cam shaft phase setter which is suitable for mass-production and combines the advantages of a space-saving and preferably centrally arranged control valve—centrally in relation to a stator-rotor arrangement of the phase setter—with a simple geometry of feeds and drains for an adjusting hydraulic fluid, but nonetheless does not show any practically significant dependence between the characteristic curve of the valve and the fluid pressure which prevails in the feed to the valve.

The invention correspondingly relates to a cam shaft phase setter comprising a preferably central control valve for controlling the feeding and draining of a hydraulic fluid into and out of a pressure chamber which serves to adjust the rotational angular position of a cam shaft relative to a crankshaft of an internal combustion engine. The pressure chamber can be either a leading chamber which adjusts the cam shaft to lead relative to the crankshaft when the pressure is applied, or a trailing chamber which adjusts the cam shaft to trail when the pressure is applied. A release of pressure is accompanied by a resetting in the opposite rotational direction. In preferred embodiments, the cam shaft phase setter comprises one or more pressure chamber(s) for leading and one or more additional pressure chamber(s) for trailing. In such embodiments, the phase position of the cam shaft is set by introducing the pressurised fluid by means of the control valve into either the pressure chamber(s) for leading or the pressure chamber(s) for trailing, and connecting the other type of pressure chamber(s) in each case to a low-pressure side of the fluid, preferably to a reservoir for the fluid such as for example an oil sump. The fluid can in particular be a lubricating oil which serves to lubricate the internal combustion engine—in the case of motor vehicles, typically the engine oil.

The control valve comprises a valve housing comprising at least one operating port and at least one reservoir port for the fluid. The operating port serves to feed said pressure fluid to the at least one pressure chamber of the phase setter, and the reservoir port serves to drain it to a reservoir provided on the low-pressure side of the fluid. The operating port preferably also serves to drain fluid from the pressure chamber via the reservoir port. The control valve also comprises a valve piston which can be axially adjusted back and forth in the valve housing between a first piston position and a second piston position. The valve piston is hollow, i.e. it comprises an axial hollow space into which fluid from a high-pressure side—a pressure fluid—can be introduced via a valve piston inlet. The introduced pressure fluid is channelled out of the hollow space via a piston outlet. In the first piston position, the piston outlet is connected to the operating port of the valve housing such that the pressure fluid can be fed through the valve piston via the operating port of the pressure chamber. In the second piston position, the piston outlet is separated from the operating port of the valve housing. The valve piston outlet is preferably connected to the reservoir port of the valve housing in the second piston position. In preferred embodiments, the valve housing comprises a housing inlet through which the fluid of the high-pressure side can be introduced into the valve housing and, through the piston inlet connected to the housing inlet, into the hollow space of the valve piston.

An actuating unit, coupled to the valve piston, for axially adjusting the valve piston is also part of the cam shaft phase setter. The actuating unit is preferably an electromagnetic actuating unit and can in particular be an axial stroke electromagnet. The coupling is preferably such that the actuating unit only applies an axial pressure force to the valve piston; alternatively or as applicable also additionally, however, it would be conceivable to apply an axial traction force. For the coupling to the actuating unit, the valve piston preferably comprises a coupling member which protrudes through an axially facing closure wall which closes off the valve housing. The coupling member is correspondingly able to move axially back and forth relative to the axially facing closure wall of the valve housing; nevertheless, the axially facing closure wall seals the valve housing with the required tightness of seal in a tight fit with the coupling member. The coupling member preferably acts as an axial plunger.

In order to prevent the fluid from being able to exert any practically relevant axial pressure force—and resultant axial thrust—on the hollow valve piston despite flowing through it, the valve piston comprises a radial widening, i.e. a radially widened piston portion, which is surrounded in a tight fit by a complementarily widened housing portion of the valve housing and to which the fluid of the high-pressure side can be applied in an axial direction pointing away from the axially facing closure wall. The widening is cross-sectionally dimensioned such that the fluid acts on the valve piston with a pressure force of at least substantially equal size in both axial directions despite the coupling member protruding through the axially facing closure wall. If, as is common in the prior art, the valve piston exhibited the same outer circumference over the whole of its axial length, a resultant axial pressure force dependent on the fluid pressure and acting on the valve piston would correspond to the difference in area between the axially facing areas of the valve piston which face axially away from each other and are projected axially in parallel, multiplied by the current fluid pressure. The difference in area would correspond to the cross-sectional area of the coupling member in the region of the axially facing closure wall, since the fluid cannot be applied to this area when the coupling is established on the low-pressure side of the fluid, as is preferred. Arranging the actuating unit on the low-pressure side has the advantage that no particular sealing measures have to be taken for the actuating unit.

The axial hollow space of the valve piston is preferably a central, cylindrical hollow space which expediently tapers in a simple straight line at the inlet end and thus forms the piston inlet with a cross-sectional area corresponding to the hollow space cross-section. The fluid thus flows with little resistance into the valve piston and through the piston outlet to the pressure chamber when the valve piston assumes the corresponding axial piston position. The piston outlet is preferably a radial outlet on the circumference of the valve piston. The axial flow in and radial flow out are conducive to a simple profile of the feeds and drains and correspondingly to an extensive geometric freedom of scope with respect to the channel cross-sections of the feed to the valve piston and the drain to the pressure chamber and the reservoir.

In preferred embodiments, the housing inlet is formed on an axially facing side of the valve housing, such that the fluid which flows to the control valve already flows axially into the control valve. In principle, however, the housing inlet can also be a radial inlet on the circumference of the valve housing. Although less preferred, a housing inlet which leads obliquely into the control valve is also not to be ruled out. The operating port preferably extends radially through the circumference of the valve housing. If, as is preferred, an additional operating port is provided, then the latter also preferably extends in a simple straight line radially through the valve housing. A radial profile is also advantageous for the reservoir port, and also for an additional reservoir port if one is provided. In alternative embodiments, the reservoir port, the optional additional reservoir port, the operating port or the optionally additional operating port can also run obliquely through the circumference of the valve housing.

The control valve is preferably arranged such that it rotates with the cam shaft. It is preferably inserted at an axial end of the cam shaft into a central accommodating space which is open towards the axially facing end of the cam shaft, from the axially facing end. A co-rotating control valve, in particular a control valve which is central in relation to the phase setter, can however in principle also be placed at the axially facing end of the cam shaft only. A central control valve which rotates with the cam shaft enables a space-saving design for the cam shaft phase setter and a geometrically simple way of feeding the pressure fluid through the cam shaft.

The actuating unit is preferably arranged on the low-pressure side of the fluid and can in particular be at atmospheric pressure, such that no particular sealing measures have to be taken. The actuating unit is preferably arranged such that it cannot be rotated relative to the engine housing of the internal combustion engine, such that if the control valve is advantageously arranged such that it can be rotated with the cam shaft, the coupling member of the valve piston can be rotated relative to the actuating unit, the actuating unit being viewed as a whole. As already mentioned, the actuating unit can in particular be an electromagnetic actuating unit, comprising an electromagnetic coil and an anchor which can be axially moved relative to the coil and is or at least can be arranged such that it cannot be rotated relative to the coil, since the relative rotation is performed in the coupling between the coupling member and the actuating unit. Preferably, the actuating unit and the coupling member are directly in a coupling engagement with each other. The coupling is preferably an axial pressure contact only—in the case of direct engagement, a pressure contact between an actuating element of the actuating unit and the coupling member—in which the actuating element, for example said anchor, presses axially against an axially facing end of the coupling member.

A control valve which is central in relation to the rotor of the phase setter and can be or is connected, rotationally fixed, to the cam shaft, in combination with a valve piston which is arranged such that it can be rotated relative to the axially movable acting element of the actuating unit is already advantageous in itself, without compensating for any axial thrust. If such a combination of a hydraulic part of the control valve and the actuating unit is realised, it is also preferred if the valve piston comprises the axial hollow space described and the fluid of the high-pressure side can thus flow through it. The coupling can be embodied as disclosed within the present invention. Alternatively, however, the coupling can also be configured such that when the actuating unit is embodied as an axial stroke actuating unit, its acting element—for example, the anchor of a magnet—protrudes through the axially facing closure wall of the valve housing and acts within the valve housing on the axially facing end of the valve piston which faces it. Such an acting element can in principle also form the coupling member of the invention claimed here.

Within the aspect of forming separation points between rotating and non-rotating components of the control valve, the subject of the invention is therefore in particular also a cam shaft phase setter comprising a control valve for controlling the feeding and draining of a hydraulic fluid into and out of a pressure chamber which serves to adjust the rotational angular position of a cam shaft relative to a crankshaft of an internal combustion engine, the control valve comprising:

a) a valve housing which comprises a housing inlet, an operating port to the pressure chamber and a reservoir port to a reservoir for the fluid and is connected, rotationally fixed, to the cam shaft or is formed by the cam shaft;

b) a valve piston which can be axially adjusted back and forth in the valve housing between a first position and a second position and comprises a piston feed which is connected to the housing inlet and is connected to the operating port in the first position of the valve piston and separated from the operating port in the second position of the valve piston;

c) an actuating unit which is coupled to the valve piston and comprises an electromagnetic coil which is connected, rotationally fixed, to an engine housing of the internal combustion engine, and an anchor which can be axially moved relative to the coil;

d) and a coupling member which extends axially between the valve piston and the anchor and protrudes through an axially facing closure wall which closes off the valve housing, in order to transmit an axial actuating force of the actuating unit onto the valve piston;

e) wherein the valve piston can be rotated relative to the anchor.

Features a) to e) above can be advantageously supplemented by any of the features disclosed within the invention claimed here; conversely, Features a) to e) above—each individually and in any combination—can also advantageously develop the invention claimed here. The valve piston can comprise an axial hollow space; in such embodiments, the piston feed would be said piston inlet. If the fluid to be controlled by means of the valve piston is not introduced into the valve piston, but rather—as described with respect to the prior art—guided on the outer circumference of the valve piston, then said piston feed is a recess which is formed on the circumference of the valve piston and connects the housing inlet to the operating port and preferably encircles it in the corresponding piston position.

Although it is conceivable for the coupling and the actuating unit to be disposed such that the actuating unit can exert both axial traction forces and pressure forces, i.e. such that the actuating unit presses the valve piston into one of the piston positions and pulls it into the other, embodiments are preferred in which the control valve comprises a spring unit, preferably a mechanical spring such as for example a helical pressure spring, which acts with its spring force on the valve piston to counter the actuating force of the actuating unit. The spring unit can advantageously be arranged such that it is supported at one spring end directly on the valve housing and at another spring end directly on the valve piston and thus tensions the valve piston in the corresponding axial direction.

If the difference in area is caused by the coupling member only, the widening is preferably cross-sectionally dimensioned such that at least approximately and preferably exactly the cross-sectional area over which the coupling member protrudes through the axially facing closure wall is compensated for. The valve piston is preferably circular-cylindrical at the outer circumference in the widened piston portion, such that the widening provides a circular annular area which at least approximately and preferably exactly compensates for the cross-sectional area of the coupling member. The fluid of the high-pressure side is applied to the control piston on the axially facing side of the widening which faces the axially facing closure wall of the valve housing. Although it is conceivable for this compensating pressure fluid to be fed for example from outside the valve piston or even from outside the control valve, it is in accordance with more preferred embodiments if the fluid is guided through the axial hollow space of the valve piston onto the compensating area formed by the widening. The casing of the hollow space or preferably an axially facing piston wall of the hollow space can comprise a single passage or a plurality of passages arranged in a distribution around the central longitudinal axis of the valve piston, through which the pressure fluid can flow to the axially facing area of the valve piston which faces the axially facing closure wall of the valve housing, and in particular to the compensating area of the widening.

The widening preferably forms the axially facing end of the valve piston which faces the axially facing closure wall, from which the coupling member preferably projects towards the actuating unit. In such embodiments, the compensating area formed by the widening is an end area of the valve piston which axially lies directly opposite the axially facing closure wall. In principle, however, it would also be conceivable to provide the widening not in the axial end portion near the axially facing closure wall of the valve housing but rather in a middle axial portion or even in the other end portion of the valve piston, away from the axially facing closure wall. Forming the widening at the end of the valve piston which faces the axially facing closure wall, however, allows fluid to be fed in a particularly simple way through the axial hollow space at the end of the valve piston which faces away from the piston inlet. This enables compensating in accordance with the invention to be decoupled from the control function of the control valve in a simple way.

The widened housing portion extends axially beyond the widened piston portion, in order to enable the axial adjusting movements of the valve piston. On the side facing away from the axially facing closure wall, preferably only the fluid pressure of the low-pressure side is applied to the valve piston in the region of the widening. The reservoir port or an additional reservoir port in the widened housing portion is preferably arranged on the side of the widening which faces away from the axially facing closure wall, such that the fluid pressure of the reservoir at least substantially prevails on this side.

In developments, a side of the valve piston which faces away from the axially facing closure wall comprises a radial and preferably circumferential recess, axially connected to the widening. The arrangement of the operating port and reservoir port of the valve housing and the axial length of the recess are preferably such that the operating port is connected to the reservoir port via the recess in the second piston position of the valve piston. In the first piston position, a control edge of the valve piston which delimits the recess separates the operating port from the reservoir port. Preferably, the control edge is arranged axially on the valve piston, and the actuating unit able to be controlled, such that the valve piston can also be positioned in intermediate positions between the first and second position, such that the control piston can also only partially cover and release the reservoir port. It is also advantageous if the axial speed at which the valve piston is moved from the first position towards the second position or from the second position towards the first position can be varied, i.e. if the valve piston can also be moved at different speeds.

In developments, the cam shaft phase setter comprises an additional pressure chamber for the fluid. The fluid of the high-pressure side is applied to either one or the other of these at least two pressure chambers. Correspondingly, the application of pressure to one pressure chamber causes the cam shaft to be adjusted in the leading direction relative to the crankshaft, and when the pressure is applied to the other pressure chamber, the cam shaft is adjusted to trail in the opposite rotational direction. In such embodiments, the control valve is disposed to channel the pressure fluid selectively into either one pressure chamber or the other pressure chamber. For this function to be fulfilled, the valve housing comprises an additional operating port through which the fluid can flow to the additional pressure chamber. The additional operating port is formed in the valve housing such that the piston outlet is connected to the additional operating port in the second piston position and is separated from the additional operating port in the first piston position. In the first piston position, the additional operating port is preferably connected to the reservoir, such that the pressure fluid can flow off from the additional pressure chamber into the reservoir via the additional operating port. In order to effect this release of pressure, the valve piston can comprise an additional radial recess, preferably likewise a circumferential recess, which connects the additional operating port of the valve housing to the reservoir, preferably to an additional reservoir port of the valve housing which is connected to the reservoir, in the first piston position. Although less preferred, it would however nonetheless be possible to provide only a single reservoir port in the valve housing and to configure the profile of the channels such that the additional operating port is connected to this same reservoir port in the first piston position.

In embodiments in which the valve housing comprises said two operating ports and said two reservoir ports, these ports are preferably arranged such that the two operating ports are arranged axially between the two reservoir ports, i.e. such that one of the reservoir ports is followed by the operating port assigned to it, which is followed by the other operating port, which is followed by the reservoir port assigned to said other operating port, as viewed in the axial direction. The adjusting paths which the valve piston travels in order to selectively connect either one operating port to one type of pressure chamber(s) or the other operating port to the other type of pressure chamber(s) can be kept short by means of an arrangement sequenced in this way. Axially extending recesses on the outer circumference of the valve piston can connect the operating port which ensures the release of pressure in the assigned pressure chamber(s) to the assigned reservoir port by a short path in the control valve. Including the housing inlet, the feeds and drains are preferably arranged axially in the following order: the housing inlet is formed near or preferably at an axially facing end of the valve housing and is followed axially in the direction of the other axially facing end of the valve housing by the additional reservoir port, which is followed by the additional operating port, then the first operating port and finally, axially furthest away from the housing inlet, the first reservoir port.

In developments, the cam shaft phase setter is configured such that the fluid fed and preferably any fluid flowing through the control valve flows back into the engine housing through one or more component(s) of the phase setter which rotate with the cam shaft, when the pressure in the pressure chamber is released as is required for adjusting the phase position, and does not first flow off into an attachment housing attached to the outside of the engine housing, for example a chain case, from where it has to be guided back to the reservoir. In such embodiments, the internal combustion engine—for example, its engine housing—does not have to be specially disposed for a feedback of the fluid flowing off from the phase setter. This facilitates mounting the phase setter. In advantageous embodiments, the feedback extends through the rotor of the phase setter which is connected, rotationally fixed, to the cam shaft when mounted and is provided with a corresponding feedback, preferably a passage which extends in an axial straight line through the rotor, for this purpose. Although a single passage can form the feedback, it is preferred if the feedback comprises a plurality of passages which are arranged in a distribution around the rotational axis of the rotor. A continuative feedback, connected to the feedback of the rotor, can extend in the stator, wherein the continuative feedback can be formed for example by one or more bore(s) in the stator or one or more groove-shaped or fully circumferential inner widening(s) or can be delimited jointly by the stator radially on the outside and by the cam shaft radially on the inside. If the control valve comprises said additional reservoir port, the fluid which is required for adjusting the phase position of the cam shaft is preferably guided back into the engine housing via both reservoir ports, through the phase setter which rotates with the cam shaft.

The feedback within the phase setter which is arranged such that it can be rotated with the cam shaft and which rotates during operation of the internal combustion engine is also advantageous in its own right, for example without compensating by widening the valve piston, i.e. even without the characterising portion of the main claim. The feedback within the cam shaft phase setter, i.e. within one or more component(s) of the phase setter which is/are arranged such that it/they rotate with the cam shaft during operation of the internal combustion engine, is however also advantageous in general and not only in connection with a hollow valve piston through which the fluid can flow. A feedback within the phase setter can thus also be advantageous for phase setters which comprise a central control valve comprising a valve piston to which the fluid is only fed on the outer circumference, i.e. which the fluid does not flow through. A hollow valve piston is however favourable in terms of a channel profile which is as simple as possible. Furthermore, a central control valve comprising either a hollow valve piston through which fluid can therefore flow or a valve piston through which fluid cannot flow can also comprise an actuating unit which, as is not preferred, comprises an anchor which does not rotate relative to the coil but is rather for example connected, rotationally fixed, to the valve piston.

Thus, within the aspect of the feedback within the phase setter, the invention also relates to a cam shaft phase setter for adjusting the rotational angular position of a cam shaft relative to a crankshaft of an internal combustion engine by means of a hydraulic fluid, said cam shaft phase setter comprising:

a) a stator which can be rotary-driven by the crankshaft;
b) a pressure chamber for the fluid;
c) a rotor which is connected, rotationally fixed, to the cam shaft and coupled to the stator such that torque is transmitted and which can be adjusted in its rotational angle relative to the stator by introducing the fluid into the pressure chamber;
d) a valve housing which comprises a housing inlet, an operating port to the pressure chamber and a reservoir port to a reservoir for the fluid and is connected, rotationally fixed, to the cam shaft or is formed by the cam shaft;
e) a valve piston which can be axially adjusted back and forth in the valve housing between a first position and a second position and comprises a piston feed which is connected to the housing inlet and is connected to the operating port in the first position of the valve piston and separated from the operating port in the second position of the valve piston;
f) an actuating unit, coupled to the valve piston, for axially adjusting the valve piston;
g) and a feedback through which—with the exception of leakage fluid at most—all of the fluid which flows through the valve housing can be fed back into an engine housing of the internal combustion engine which rotatably mounts the cam shaft,
h) wherein the feedback extends from the reservoir port to the engine housing through the cam shaft phase setter only.

Features a) to h) above can be advantageously supplemented by any of the features disclosed within the invention claimed here; conversely, Features a) to h) above—each individually and in any combination—can also advantageously develop the invention claimed here. The valve piston can comprise an axial hollow space; in such embodiments, the piston feed would be said piston inlet. If the fluid to be controlled by means of the valve piston is not introduced into the valve piston, but rather—as described with respect to the prior art—guided on the outer circumference of the valve piston, then said piston feed is a recess which is formed on the circumference of the valve piston and connects the housing inlet to the operating port and preferably encircles it in the corresponding piston position.

The valve housing can in particular be screwed to the cam shaft, wherein the valve housing preferably comprises an outer thread, and the cam shaft correspondingly comprises an inner thread in an accommodating space, for the screw connection. If the valve housing and the cam shaft are connected to each other by means of a screw connection, a screw head of the valve housing can also simultaneously close off said feedback for the fluid, if one is provided within the phase setter. The valve housing can in particular serve as a tensioning screw for mounting the rotor and the stator of the cam shaft phase setter, such that the phase setter is also simultaneously mounted when the screw connection is established. A valve housing which is formed as a central tensioning screw can assume the function of a centring element for the rotor of the cam shaft phase setter, by centring the rotor relative to the cam shaft. In alternative embodiments, the valve housing can also be formed as a housing cartridge which is only inserted axially into the cam shaft and is then axially secured by a securing device, for example a securing ring. A housing cartridge, or also a valve housing which can be screwed, can be additionally or exclusively secured axially in a material fit, for example by a welding connection. In other embodiments again, the valve housing can also be directly formed by the cam shaft itself or joined to an axial end of the cam shaft by means of a material-fit connection. A valve housing which can be mounted in a positive fit or in a frictional fit is however preferred.

The axially facing closure wall through which the coupling member protrudes can expediently be formed by a closure disc which is fixedly joined to a casing of the valve housing. The closure disc can for example be joined to the casing of the valve housing by being press-fitted or by means of a screw connection or welding connection, which also includes combinations of these joining methods which are cited by way of example.

Advantageous features are also disclosed in the subclaims and combinations of them.

Advantageous features of the invention are described also in the following aspects:

Aspect 1#. A cam shaft phase setter comprising a control valve for controlling the feeding and draining of a hydraulic fluid into and out of a pressure chamber (8) which serves to adjust the rotational angular position of a cam shaft (1) relative to a crankshaft of an internal combustion engine, the control valve comprising:

a) a valve housing (10) which comprises an operating port (B) to the pressure chamber (8) and a reservoir port ($T_B$) to a reservoir for the fluid;
b) a valve piston (20) which can be axially adjusted back and forth in the valve housing (10) between a first position and a second position and comprises an axial hollow space (21), a piston inlet (22) for introducing the fluid into the hollow space (21), and a piston outlet (23) which leads out of the hollow space (21) and is connected to the operating port (B) in the first position of the valve piston (20) and separated from the operating port (B) in the second position of the valve piston (20);
c) an actuating unit (15), coupled to the valve piston (20), for axially adjusting the valve piston (20);

d) and a coupling member (25) which protrudes through an axially facing closure wall (11) which closes off the valve housing (10), and couples the actuating unit (15) to the valve piston (20);

characterised in that e) the valve piston (20) comprises a radial widening (28) which is surrounded by a complementarily widened housing portion (18) of the valve housing (10) and to which the fluid can be applied in an axial direction pointing away from the axially facing closure wall (11), in order to generate an axial pressure force, f) and the widening (28) is dimensioned such that the fluid acts on the valve piston (20) with a pressure force of at least substantially equal size in both axial directions, despite the coupling member (25).

Aspect #2. The cam shaft phase setter according to the preceding aspect, characterised in that the valve housing (10) is connected, rotationally fixed, to the cam shaft (1) or is formed by the cam shaft, such that when the cam shaft (1) rotates, the control valve rotates together with it.

Aspect #3. The cam shaft phase setter according to any one of the preceding aspects, characterised in that: the actuating unit (15) comprises an electromagnetic coil (16) and an anchor (17) which can be axially moved relative to the coil (16); the coil (16) is connected, rotationally fixed, to an engine housing (2) of the internal combustion engine which rotatably mounts the cam shaft (1); the anchor (17) acts axially on the coupling member (25); and the coupling member (25) can be rotated relative to the anchor (17).

Aspect #4. The cam shaft phase setter according to any one of the preceding aspects, characterised in that a spring unit (14) acts on the valve piston (20) in the direction of the first position, and the actuating unit (15) acts on the valve piston (20) in the direction of the second position via the coupling member (25).

Aspect #5. The cam shaft phase setter according to any one of the preceding aspects, characterised in that the widening (28) forms an axial end area ($F_{28}$) of the valve piston (20) which faces the axially facing closure wall (11), and the coupling member (25) preferably projects axially from this end area ($F_{28}$).

Aspect #6. The cam shaft phase setter according to any one of the preceding aspects, characterised in that the reservoir port ($T_B$) is arranged in the widened housing portion (18) on a side of the widening (28) which faces away from the axially facing closure wall (11), such that at least substantially only the pressure of the reservoir is applied to the widening (28) on this side.

Aspect #7. The cam shaft phase setter according to the preceding claim, characterised in that the valve piston (20) comprises a radial recess (27), axially connecting to the widening (28), on a side facing away from the axially facing closure wall (11), wherein said recess (27) is preferably a circumferential recess (27) and connects the operating port (B) to the reservoir port ($T_B$) in the second position of the valve piston (20).

Aspect #8. The cam shaft phase setter according to any one of the preceding aspects, characterised in that: an additional pressure chamber (9) for the fluid is provided; one of the pressure chambers (8, 9) acts in the direction of the cam shaft (1) leading, and the other acts in the direction of the cam shaft (1) trailing; the valve housing (10) comprises an additional operating port (A), axially spaced from the operating port (B), in order to guide the fluid to the additional pressure chamber (9); and the piston outlet (23) is connected to the additional operating port (A) in the second position of the valve piston (20) and separated from the additional operating port (A) in the first position of the valve piston (20).

Aspect #9. The cam shaft phase setter according to the preceding claim, characterised in that the valve piston (20) comprises a radial recess (26), preferably a circumferential recess (26), which connects the additional operating port (A) of the valve housing (10) to the reservoir, preferably to an additional reservoir port ($T_A$) of the valve housing (10) which is connected to the reservoir, in the first position of the valve piston (20).

Aspect #10 The cam shaft phase setter according to any one of the preceding aspects, characterised in that: the valve housing (10) comprises an additional operating port (A) and an additional reservoir port ($T_A$); the valve piston outlet (23) is connected to the additional operating port (A) in the second position of the valve piston (20) and separated from the additional operating port (A) in the first position of the valve piston (20); and the valve piston (20) connects the additional operating port (A) to the additional reservoir port ($T_A$) in the first position of the valve piston (20).

Aspect #11. The cam shaft phase setter according to the preceding aspect, characterised in that the valve housing (10) comprises the ports (A, B, $T_A$, $T_B$) in the axial order: additional reservoir port ($T_A$), additional operating port (A), operating port (B) and reservoir port ($T_B$); and preferably comprises the housing inlet ($P_a$; $P_r$) axially in front of the additional reservoir port ($T_A$).

Aspect #12. The cam shaft phase setter according to any one of the preceding four aspects, characterised in that the fluid can be fed back from the reservoir port ($T_B$) or the optional additional reservoir port ($T_A$), in a feedback (4*a*, 7*a*, 4') which can be rotated with the cam shaft (1), into an engine housing (2) of the internal combustion engine which rotatably mounts the cam shaft (1).

Aspect #13. The cam shaft phase setter according to any one of the preceding aspects and at least one of the following features:

(i) the housing inlet ($P_a$) leads axially into the valve housing (10) on an axially facing side of the valve housing (10);

(ii) the piston inlet (22) leads axially into the hollow space (21) on an axially facing side of the valve piston (20).

Aspect #14. The cam shaft phase setter according to any one of the preceding aspects, characterised in that the valve housing (10) is inserted into an accommodating space (1*a*) of the cam shaft (1) and is screwed to the cam shaft (1) or axially secured by means of a securing device (31), wherein a tensioning screw which can be screwed to the cam shaft (1) preferably forms the valve housing (10).

Aspect #15. The cam shaft phase setter according to any one of the preceding aspects, comprising a stator (3) which can be rotary-driven by the crankshaft, and a rotor (7) which is connected, rotationally fixed, to the cam shaft (1) and coupled to the stator (3) such that torque is transmitted and which can be adjusted in its rotational angle relative to the stator (3) by introducing the fluid into the pressure chamber (8).

Aspect #16. The cam shaft phase setter according to the preceding aspect, characterised in that the reservoir port ($T_B$) and also, if it is provided, the additional reservoir port ($T_A$) according to any one of claims 9 to 12 is/are connected to a feedback (4*a*, 7*a*, 4') which extends within an arrangement which comprises the stator (3), the rotor (7), the control valve and the cam shaft (1) and can be rotated together with the cam shaft (1), in order to guide the fluid back into an engine housing (2) of the internal combustion engine which rotatably mounts the cam shaft (1), preferably via a feedback (4*a*, 7*a*, 4') which runs at least substantially axially.

Aspect #17. The cam shaft phase setter according to any one of the preceding aspects, characterised in that: a feedback (4*a*, 7*a*, 4') is provided, through which—with the exception of leakage fluid at most—all of the fluid which flows through the valve housing (10) can be fed back into an engine housing (2) of the internal combustion engine which rotatably mounts the cam shaft (1); and the feedback (4*a*, 7*a*, 4') extends from the reservoir port ($T_B$) and also, if it is provided, the additional reservoir port ($T_A$) according to any one of claims 9 to 12 to the engine housing (2) through the cam shaft phase setter only.

Aspect #18. The cam shaft phase setter according to any one of the preceding aspects in combination with any one of claims 12, 16 and 17, characterised in that the valve housing (10) is or can be screwed to the cam shaft (1), and a screw head (19) of the valve housing (10) closes off the feedback (4*a*, 7*a*) for the fluid.

Aspect #19. The cam shaft phase setter according to any one of the preceding aspects, characterised in that a closure disc which is fixedly joined to the valve housing (10) forms the axially facing closure wall (11).

One or more of the aspects may complement and/or substitute one or more of the claims.

BRIEF DESCRIPTION OF THE DRAWINGS

Example embodiments of the invention are explained below on the basis of figures. Features disclosed by the example embodiments, each individually and in any combination of features, advantageously develop the subjects of the claims and the embodiments described above. There is shown:

DETAILED DESCRIPTION OF THE INVENTION

Figure 1:
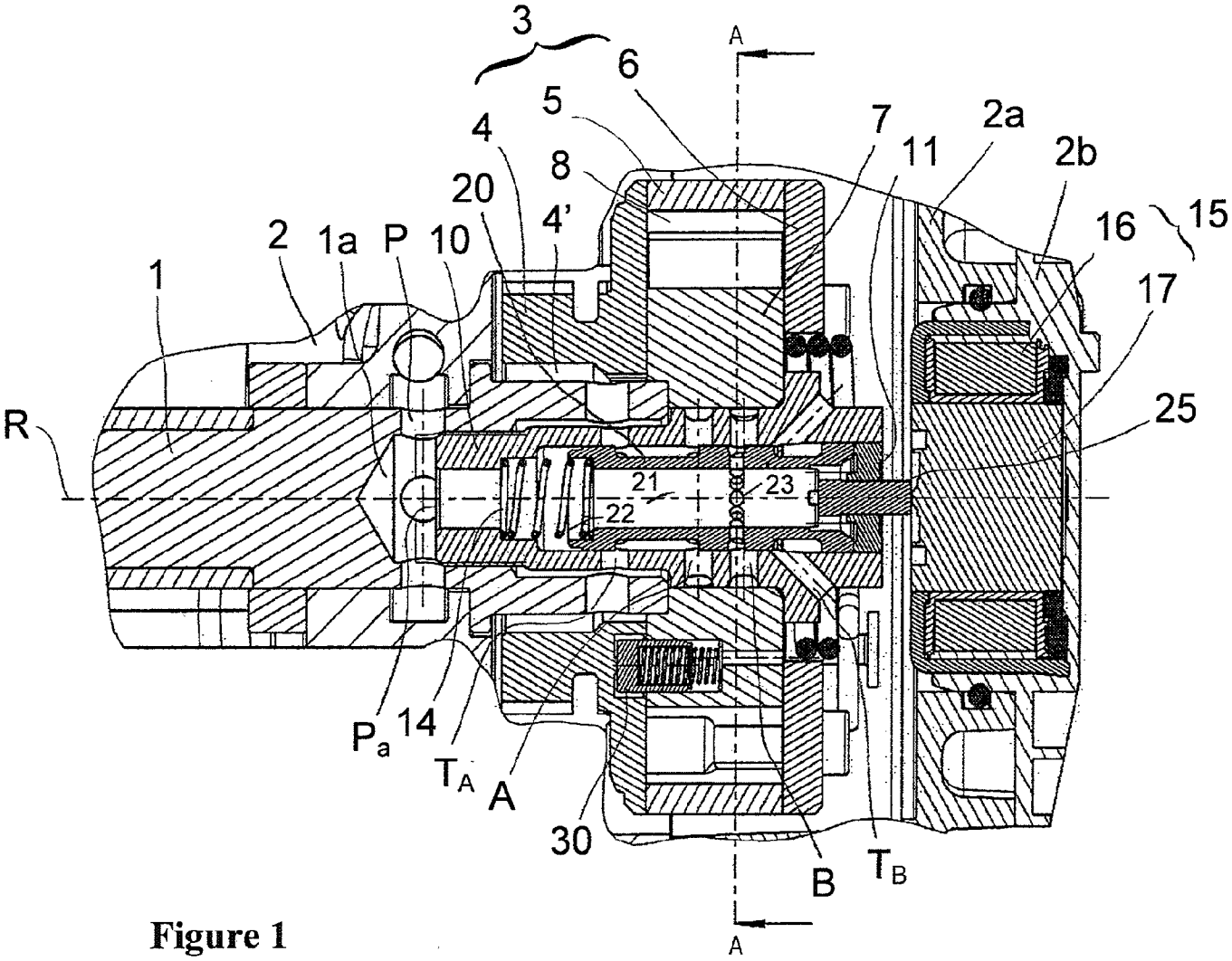
FIG. 1 a cam shaft phase setter of a first example embodiment, in a longitudinal section.

FIG. 1 shows a cam shaft phase setter in a longitudinal section. The cam shaft phase setter is arranged at an end of a cam shaft 1 on the axially facing side and serves to adjust the phase position, i.e. the rotational angular position, of the cam shaft 1 relative to a crankshaft of an internal combustion engine, for example a drive motor of a motor vehicle. The cam shaft 1 is rotatably mounted such that it can be rotated about a rotational axis R in an engine housing 2 of the internal combustion engine, usually in a cylinder head housing.

The cam shaft phase setter comprises a stator 3 which can be rotary-driven by the crankshaft, and a rotor 7 which is connected, rotationally fixed, to the cam shaft 1. The stator 3 is composed of a drive wheel 4, for example a sprocket, a cover 6 and an impeller wheel 5 which is axially arranged between the drive wheel 4 and the cover 6. The drive wheel 4, the impeller wheel 5 and the cover 6 are connected, rotationally fixed, to each other. The stator 3 and the rotor 7 form a hydraulic pivoting motor.

Figure 2:
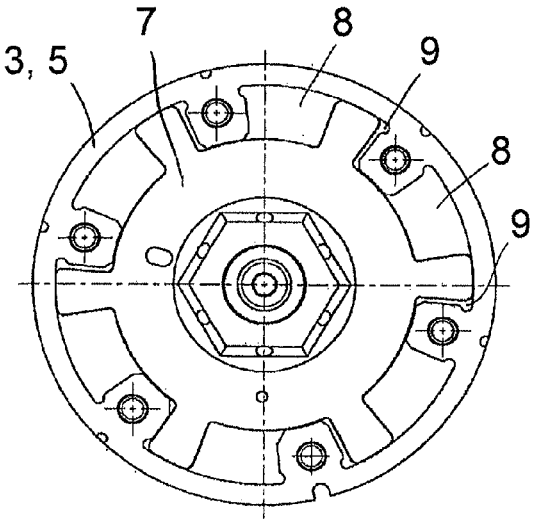
FIG. 2 a top view onto the axially facing side of the phase setter which faces away from the cam shaft, with the cover removed.

FIG. 2 shows the stator-rotor arrangement 3, 7 in a top view on the axially facing side. The cover 6 of the stator 3 is removed, such that the impeller wheel 5 of the stator 3 and the rotor 7 which is formed as an impeller counter wheel can be seen. The impeller wheel 5 forms the outer component, and the rotor 7 the inner component, of the pivoting motor. The inner circumference of the hollow impeller wheel 5 comprises vanes which project radially inwards. The rotor 7 comprises vanes which project radially outwards and form first pressure chambers 8 and second pressure chambers 9 with the vanes of the impeller wheel 5. The pressure chambers 8 are each arranged to the left of the vanes of the rotor 7 in the circumferential direction, and the pressure chambers 9 are each arranged to the right of the vanes of the rotor 7 in the circumferential direction. If the pressure chambers 8 are pressurised and the pressure chambers 9 are depressurised, the rotor 7 rotates relative to the stator 3, clockwise in FIG. 2, at most as far as the end position assumed in FIG. 2. If the pressure chambers 9 are pressurised and the pressure chambers 8 are depressurised, the rotor 7 rotates anti-clockwise. The rotational movement performed relative to the stator 3 in one rotational direction corresponds to the cam shaft 1 leading relative to the crankshaft, and the relative rotational movement in the other direction corresponds to the cam shaft 1 trailing relative to the crankshaft.

The cam shaft phase setter comprises a control valve which is arranged centrally in relation to the stator-rotor arrangement 3, 7 and comprises a valve housing 10 and a valve piston 20 which is arranged such that it can be axially moved back and forth in the valve housing 10 and thus axially adjusted. The valve piston 20 is hollow and comprises an axially extending hollow space 21, a piston inlet 22 at one axial end and a piston outlet 23 which leads radially through a casing of the valve piston 20 which surrounds the hollow space 21. The other axial end of the valve piston 20, which faces away from the piston inlet 22, comprises a coupling member 25 for a coupling to an actuating unit 15 which effects the axial adjustment of the valve piston 20. The coupling member 25 acts as an operating plunger for the valve piston 20. The coupling member 25 can be formed in one piece with the piston casing which surrounds the hollow space 21 or can as applicable be joined, axially fixed, to it. It projects at the axially facing end of the valve piston 20 which axially faces the actuating unit 15. The coupling member 25 protrudes through an axially facing closure wall 11 of the valve housing 10. The axially facing closure wall 11 surrounds the coupling member 25 in a tight fit and thus ensures that the valve housing 10 is closed off, fluidically sealed, despite the coupling member 25 being able to move back and forth.

The actuating unit 15 is an electromagnetic actuating unit—in the example embodiment, an axial stroke electromagnet—comprising a coil 16 which can be supplied with current and an anchor 17 which the coil 16 surrounds. The coil 16 is connected, rotationally fixed, to the engine housing 2 of the internal combustion engine. In the example embodiment, the coil 16 is connected, rotationally fixed, to a cover 2*b* which is in turn fixedly connected to a phase setter housing 2*a* which is mounted on the engine housing 2. The anchor 17 can be axially moved relative to the coil 16. The anchor 17 and the coupling member 25 are directly in a coupling engagement which is formed as an axial pressure contact. When the coil 16 is supplied with current, an actuating force which is directed axially towards the coupling member 25 acts on the anchor 17 and acts on the coupling member 25 in the coupling engagement, a purely axial pressure contact, and thus on the valve piston 20. Preferably, only point contact exists at the separation point between the valve piston 20 which rotates with the cam shaft 1 during operation and the actuating unit 15 which does not rotate. The end of the anchor 17 which contacts the coupling member 25 preferably exhibits a spherical surface. Alternatively, the coupling member 25 could exhibit a spherical surface at its axially facing end. In one development, the contact end of the anchor 17 is formed as a spherical slide bearing by rotatably mounting a sphere, freely and spherically, in a socket of the anchor 17 there.

The control valve comprises a spring unit 14, the spring force of which counteracts the actuating force of the actuating unit 15. The spring unit 14 is directly supported on the valve housing 10 and supported in the direction of the actuating unit 15 on the valve piston 20. The actuating unit 15 is controlled, i.e. supplied with current, by a controller of the internal combustion engine. It is preferably controlled using a characteristic map which is stored in a memory of the engine controller, for example in accordance with the rotational speed of the crankshaft, the load or other and/or additional parameters which are relevant to the operation of the internal combustion engine.

The valve piston 20 is arranged in a central axial hollow space of the valve housing 10 such that it can be moved back and forth in the way explained. Its axial end facing away from the axially facing closure wall 11 comprises a housing inlet $P_a$ which leads axially and centrally into the hollow space of the housing and to which pressurised fluid can be fed via the cam shaft 1, i.e. a pressure inlet P of the cam shaft 1. The fluid can in particular be a lubricating oil which serves to lubricate the internal combustion engine and also serves to lubricate for example the pivot bearing of the cam shaft 1. The pressure fluid is fed to the control valve, for example by the pivot bearing of the cam shaft 1 as is preferred, i.e. the pressure port P is connected to the lubricating oil supply for the pivot bearing. This pressure fluid flows into the cam shaft 1 at P, through the axial housing inlet $P_a$ into the valve housing 10, and through the piston inlet 22 which is axially flush with the housing inlet $P_a$, into the hollow space 21. A piston outlet 23 branches laterally off from the hollow space 21, for example in the radial direction as is preferred, and the pressure fluid is fed through the piston outlet 23 to either the pressure chambers 8 or the pressure chambers 9 in accordance with the axial position of the valve piston 20, in order to set the phase position of the rotor 7 relative to the stator 3 and thus the phase position of the cam shaft 1 relative to the crankshaft. The piston outlet 23 is formed by radial passages through the casing of the valve piston 20 which are arranged in a distribution over the circumference of the valve piston 20. The piston outlet 23 is arranged in an axially middle portion of the valve piston 20.

The valve housing 10 comprises ports, which lead through its casing, for feeding and draining the fluid to and from the pressure chambers 8 and 9. These include an operating port A and an operating port B, a reservoir port $T_A$ which is assigned to the operating port A, and a reservoir port $T_B$ which is assigned to the operating port B. The ports A to $T_B$ are each linear passages through the casing of the valve housing 10. The ports A, B and $T_A$ extend radially through the casing by the shortest path. The reservoir port $T_B$ extends obliquely outwards into the phase setter housing 2*a*.

Figure 3:
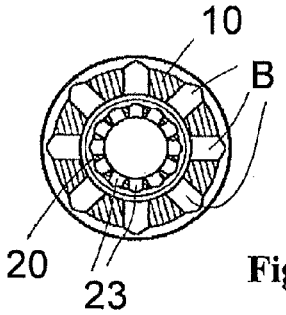
FIG. 3 a control valve of the phase setter, in the cross-section A—A from FIG. 1.

FIG. 3 shows only the control valve comprising the valve housing 10 and the valve piston 20, in the cross-section A-A from FIG. 1. The sectional representation shows in particular the piston outlet 23 of the valve piston 20 and the operating port B of the valve housing 10 which is likewise formed by radially extending and therefore short passages through the casing of the valve housing 10 which are arranged in a distribution over the circumference of the valve housing 10. The ports A, $T_A$ and $T_B$ are likewise each formed by a plurality of passage channels which are arranged in a distribution around the central axis R.

Figure 4:
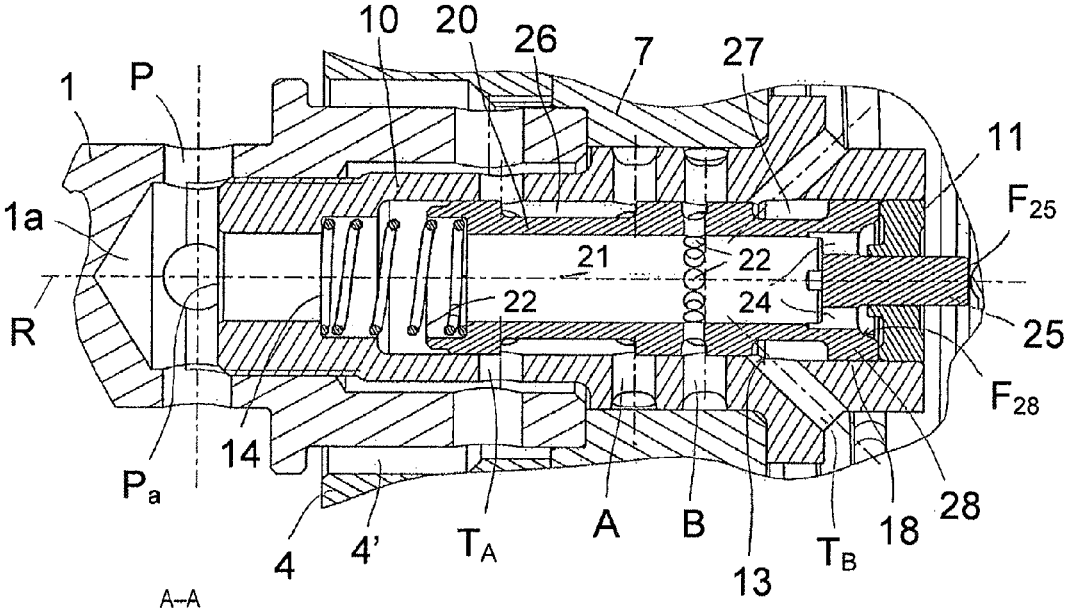
FIG. 4 a central region of the cam shaft phase setter of FIG. 1.

FIG. 4 shows only the central region of the cam shaft phase setter from FIG. 1. FIGS. 1, 3 and 4 show the valve piston 20 in a first axial piston position in which it is held by the spring unit 14. In the first piston position, the piston outlet 23 is connected to the operating port B. The pressure fluid which is fed to the cam shaft 1 via the pressure port P flows in the axial direction through the axial housing inlet $P_a$ and the piston inlet 22 into the hollow space 21 of the valve piston 20 and from there through the branching piston outlet 23 to the pressure chambers 8 which in accordance with the representation in FIG. 2 are assigned to the operating port B. The pressure chambers 9 which are connected to the operating port A are connected to the reservoir port $T_A$ via the operating port A and a recess 26 formed on the outer circumference of the valve piston 20, and to the reservoir via the reservoir port $T_A$ and a feedback 4' which rotates with the cam shaft 1, and are thus depressurised. The recess 26 extends over the entire outer circumference of the valve piston 20. Behind the piston outlet 23, as viewed in the axial direction from the recess 26, another axially extending recess 27 is formed on the outer circumference of the valve piston 20 and likewise extends over the entire outer circumference of the valve piston 20. The recess 27 is connected to the reservoir port $T_B$ in the first piston position. The reservoir port $T_B$ is assigned to the operating port B. However, it is fluidically separated from the operating port B in the first piston position by means of a sealing web of the valve piston 20 which is formed between the piston outlet 23 and the recess 27.

If an actuating force which exceeds the spring force of the spring unit 14 is applied to the anchor 17 by correspondingly supplying the actuating unit 15 with current, the actuating unit 15 pushes the valve piston 20 out of the first piston position shown, axially towards the housing inlet $P_a$ and, if the actuating force is correspondingly large, as far as an axially second piston position in which it is no longer the operating port B but rather the other operating port A which is connected to the piston outlet 23. In the second piston position, a sealing web of the valve piston 20 which is formed between the piston outlet 23 and the recess 26 separates the operating port A from its assigned reservoir port $T_A$, such that the pressure fluid is applied to the pressure chambers 9 in the second piston position. In the second piston position, the recess 27 also connects the operating port B to the reservoir port $T_B$, such that the fluid can flow off from the pressure chambers 8 and depressurise them. The rotor 7 is correspondingly moved, anti-clockwise in the representation in FIG. 2, relative to the impeller wheel 5 and thus relative to the stator 3. The cam shaft 1 which is connected, rotationally fixed, to the rotor 7 is adjusted in its piston position relative to the crankshaft by the same rotational angle.

The fluid of the high-pressure side which flows through the housing inlet $P_a$ into the control valve applies a first axial force, which acts in the direction of the actuating unit 15, to the valve piston 20. In order to compensate for this first axial force, fluid can flow through the valve piston 20 in the direction of the actuating unit 15, such that a fluid pressure builds up at its rear side facing the actuating unit 15, between said rear side and the axially facing closure wall 11, wherein said fluid pressure exerts a counter force—a second axial force—on the rear side of the valve piston 20. Since the projection area to which the pressure fluid can be applied is reduced by the cross-sectional area over which the coupling member 25 protrudes through the axially facing closure wall 11, the axial counter force—the second axial force—would be smaller than the first axial force, in accordance with the cross-sectional area of the coupling member 25. A resultant axial thrust would arise which would change in accordance with the difference between the projection areas in accordance with the fluid pressure. The characteristic curve of the control valve would correspondingly change, which can lead to significant distortions, since the fluid pressure can fluctuate during operation of the internal combustion engine.

In order to increase the second axial force, the valve piston 20 comprises a radially widened piston portion 28, referred to in the following as the widening 28, and the valve housing 10 comprises a complementarily widened housing portion 18 which surrounds the widening 28 in a tight fit. Providing the valve housing 10 and the valve piston 20 co-operate in a seal, the valve piston 20 exhibits for example the same cylindrical cross-section on the whole of its outer circumference, with the exception of the widening 28. In order to guide the pressure fluid onto the rear side of the valve piston 20, the valve piston 20 comprises a feed 24—axially behind the piston outlet 23 as viewed from the housing inlet 22—which is formed by a plurality of passage channels in a base of the valve piston 20 which are distributed around the central axis R. The widening 28 and correspondingly the housing portion 18 are dimensioned such that the increase in the projection area $F_{28}$ facing the actuating unit 15 which is provided by the widening 28 at least predominantly balances out the cross-sectional area $F_{25}$ of the coupling member 25 which is "lost" to compensating. The compensating area is an outer annular area of the projection area $F_{28}$. The additional projection area which axially faces the axially facing closure wall 11—the compensating area of the widening 28—is preferably exactly as large as the cross-sectional area $F_{25}$ over which the coupling member 25 protrudes through the axially facing closure wall 11. The result of this is that the first axial force which acts in the direction of the actuating unit 15 is compensated for by the opposing second axial force, and a resultant axial thrust cannot arise. The projection areas, which each generate an axial force when fluid flows through the valve piston 20, are of equal size in both axial directions.

The widening 28 is formed at the end of the valve piston 20 on the axially facing side, which faces the actuating unit 15, as is preferred. The widened housing portion 18 exhibits a sufficient axial extension to enable the adjusting movements of the valve piston 20. The widening 28 forms the end of the recess 27 which faces the actuating unit 15. The widened housing portion 18 tapers at 13 to the narrower cross-section which is constant in the subsequent axial profile. The taper 13 is formed within the recess 27, axially for example in the region of the reservoir port $T_B$.

A latching element 30 latches the rotor 7 in a particular rotational angular position relative to the stator 3. The latching element 30 is biased into the latching position by means of a spring unit. The fluid pressure acts in the other direction, such that when the fluid pressure increases, it is moved out of the latching position.

Figure 5:
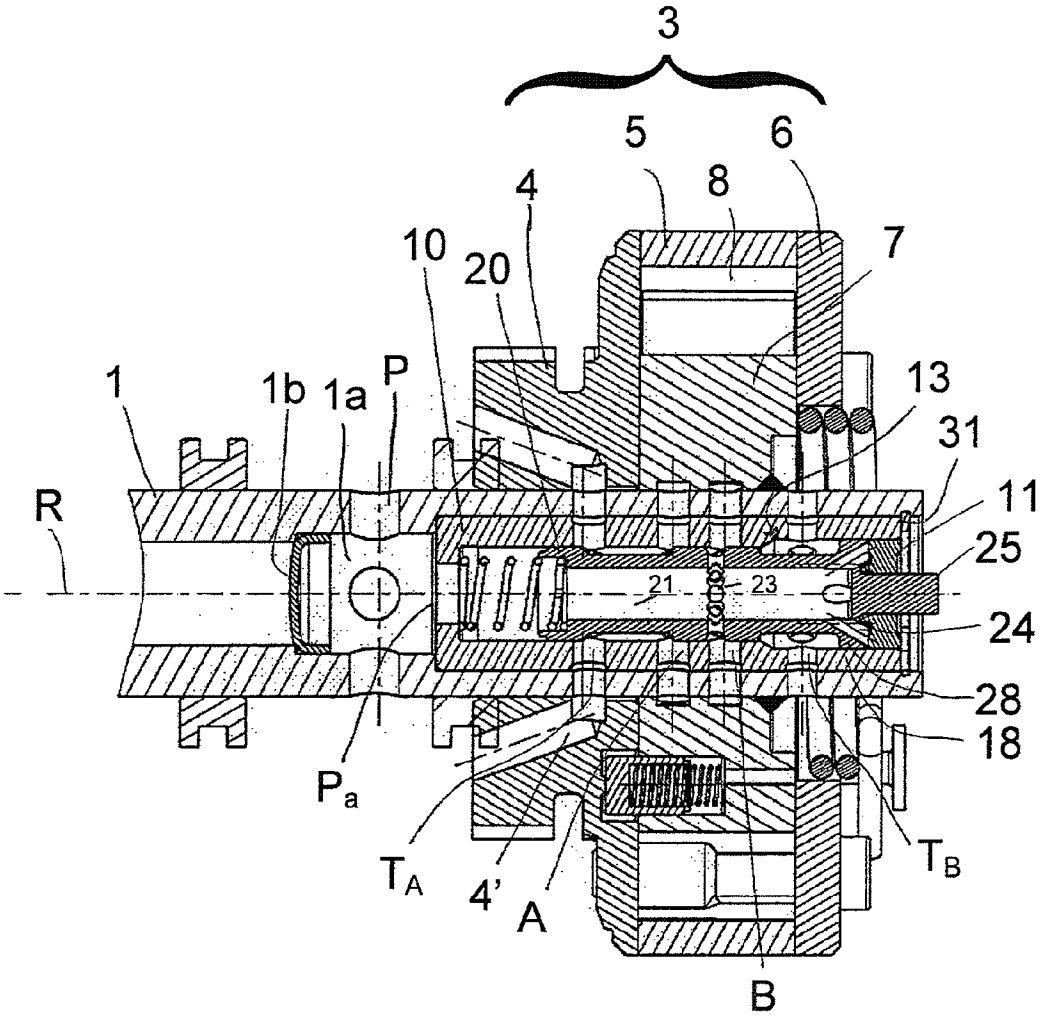
FIG. 5 a cam shaft phase setter of a second example embodiment.

FIG. 5 shows a cam shaft phase setter of a second example embodiment, likewise in a longitudinal section which includes the rotational axis R of the cam shaft 1. Unlike the first example embodiment, the valve housing 10 is not formed as a tensioning screw for the phase setter and is also not connected to the cam shaft 1 by means of a screw connection. The valve housing 10 is embodied as a housing cartridge which is inserted through the open end of the cam shaft 1 on the axially facing side into its central accommodating space 1*a*, up to and against an abutment, and once inserted is positioned in the hollow cam shaft 1 in a radially tight fit. The valve housing 10 is axially secured relative to the cam shaft 1 by means of a securing element 31, for example a securing ring.

Unlike the first example embodiment, the accommodating space 1*a* extends within the cam shaft 1 in an axial continuation. The accommodating space 1*a* is separated, in particular fluidically, from the continuative hollow space by means of a separating element 1*b* which is inserted into the cam shaft 1, in order to guide the fluid through the pressure port P of the cam shaft 1 into the accommodating space 1*a* and from there through the likewise axial housing inlet $P_a$ into the valve piston 20.

Unlike the first example embodiment, the reservoir port $T_B$ which is further away from the housing inlet $P_a$ is formed, like the other ports A, B and $T_A$, as a short radial passage in the casing of the valve housing 10. The valve piston 20 itself, as compared to the valve piston 20 of the first example embodiment, is only modified in terms of the feed 24 which serves to compensate for the axial force and does not, as in the first example embodiment, axially extend substantially in the direction of the axially facing closure wall 11 but rather runs obliquely outwards from the hollow space 21 of the piston. As in the first example embodiment, it is a plurality of passage bores which are arranged on the rear side of the valve piston 20 in a distribution around the central axis R.

The phase setter of the second example embodiment otherwise corresponds to the phase setter of the first example embodiment.

Figure 6:
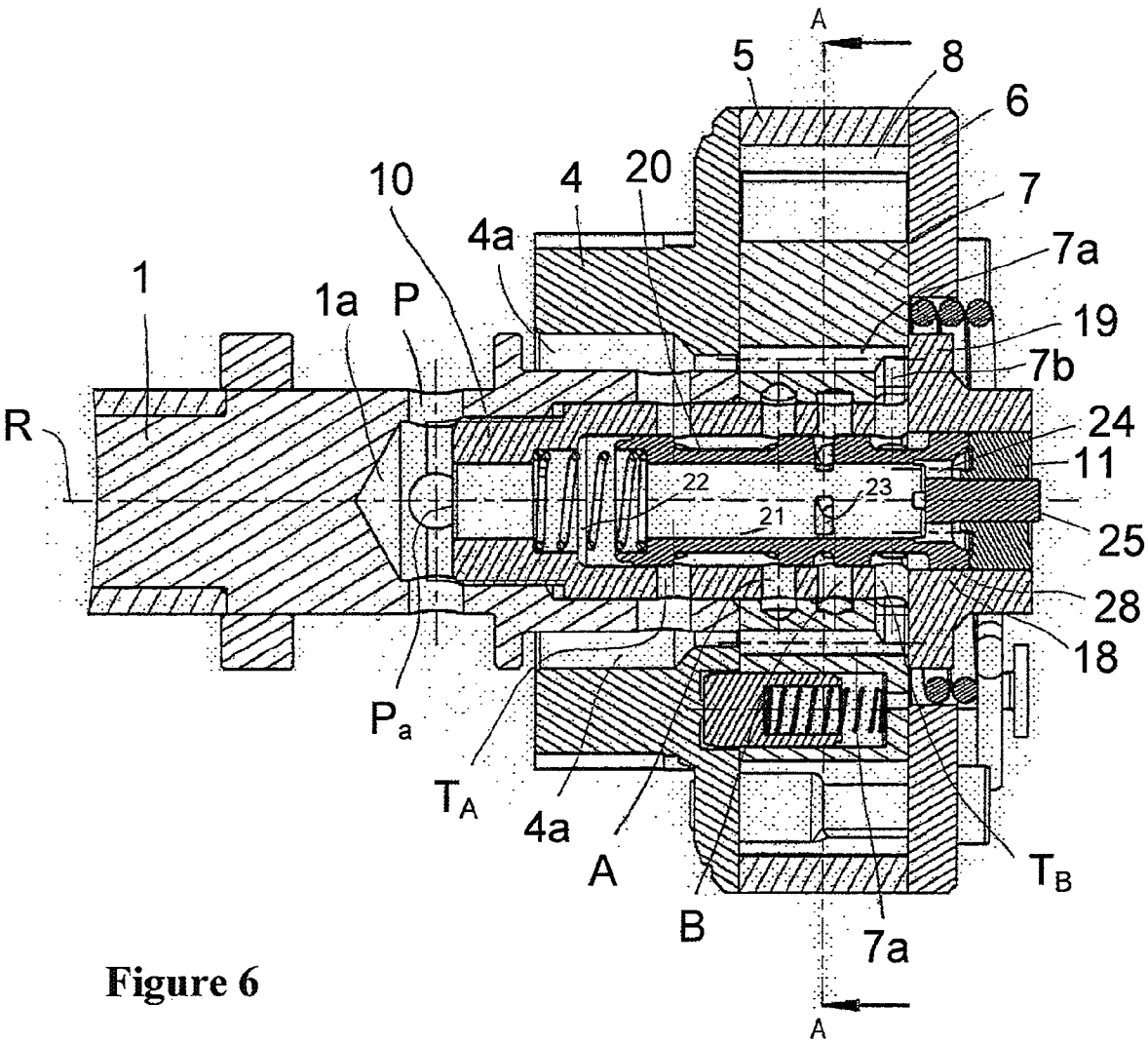
FIG. 6 a cam shaft phase setter of a third example embodiment.
Figure 7:
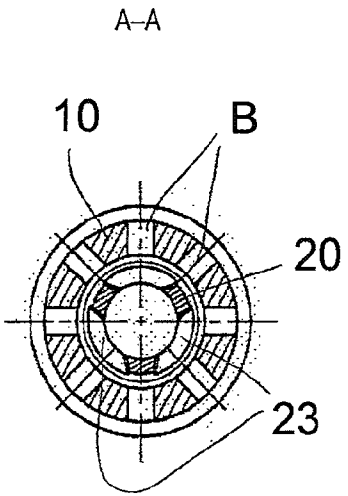
FIG. 7 the control valve, in the cross-section A—A from FIG. 6.

FIG. 6 shows a cam shaft phase setter of a third example embodiment, again in a longitudinal section which includes the rotational axis R of the cam shaft 1. FIG. 7 shows only the central control valve of this phase setter, comprising the valve housing 10 and the valve piston 20, in the cross-section A-A. The valve piston 20 corresponds to the valve piston 20 of the first example embodiment, with one exception. Unlike the first example embodiment, the piston outlet 23 is not formed by simple bores but rather by passages which extend in the manner of slits in the circumferential direction. The ports A to $T_B$ are short radial passages as in the second example embodiment, again for example passage bores in the valve housing 10 which are arranged in a distribution over the circumference.

In the phase setter of the third example embodiment, the fluid is drained through the reservoir port $T_B$ near the actuating unit 15, not into the phase setter housing 2*a* and via the phase setter housing 2*a* back into the engine housing 2 or otherwise into a reservoir for the fluid but rather via a feedback which extends within the phase setter into the engine housing as far as the low-pressure side. The feedback comprises a feedback 7*a* which extends through the rotor 7 and comprises a plurality of feedback channels arranged in a distribution around the central axis R, one feedback channel 7*a* for each of the passages which jointly form the reservoir port $T_B$. The feedback channels are for example each formed in the rotor 7 as an axially linear passage channel, as is preferred. The feedback 7*a* leads into a connecting feedback 4*a* which is delimited by the cam shaft 1 radially on the inside and by the stator 3, in this case the drive wheel 4, radially on the outside. Feeding the fluid drained through the reservoir port $T_B$ back within the phase setter which rotates together with the cam shaft 1 during operation of the internal combustion engine, preferably by its rotor 7, significantly reduces the expense of the feedback of fluid, since the feedback of any fluid required for the function of the phase setter is also automatically ensured by mounting the phase setter. The other reservoir port $T_A$, near the housing inlet $P_a$, leads back into the engine housing 2 to the low-pressure side by a short path, as in the first example embodiment above. This incidentally applies to all the example embodiments; what is new, by contrast, is the integrated feedback 4*a*, 7*a* also via reservoir port $T_B$ which lies axially further on the outside in relation to the cam shaft 1. The continuative feedback 4*a* is a common feedback for both reservoir ports $T_A$ and $T_B$.

Sealing the feedback 7*a* at the end on the axially facing side using the valve housing 10 is also advantageous in terms of a design configuration of the phase setter which is as simple as possible. The valve housing 10 is connected to the cam shaft 1 by means of a screw connection, as in the first example embodiment. In the third example embodiment, however, the screw head 19 serves an additional function as a seal for the feedback 7*a*, thus enabling its profile to be simplified, for example to a simply linear passage through the rotor 7. The connection between the reservoir port $T_B$ and the feedback 7*a* is also configured simply, i.e. in the form of radial grooves at the axially facing end of the rotor 7.

The statements made with respect to the first example embodiment otherwise apply.

Figure 8:
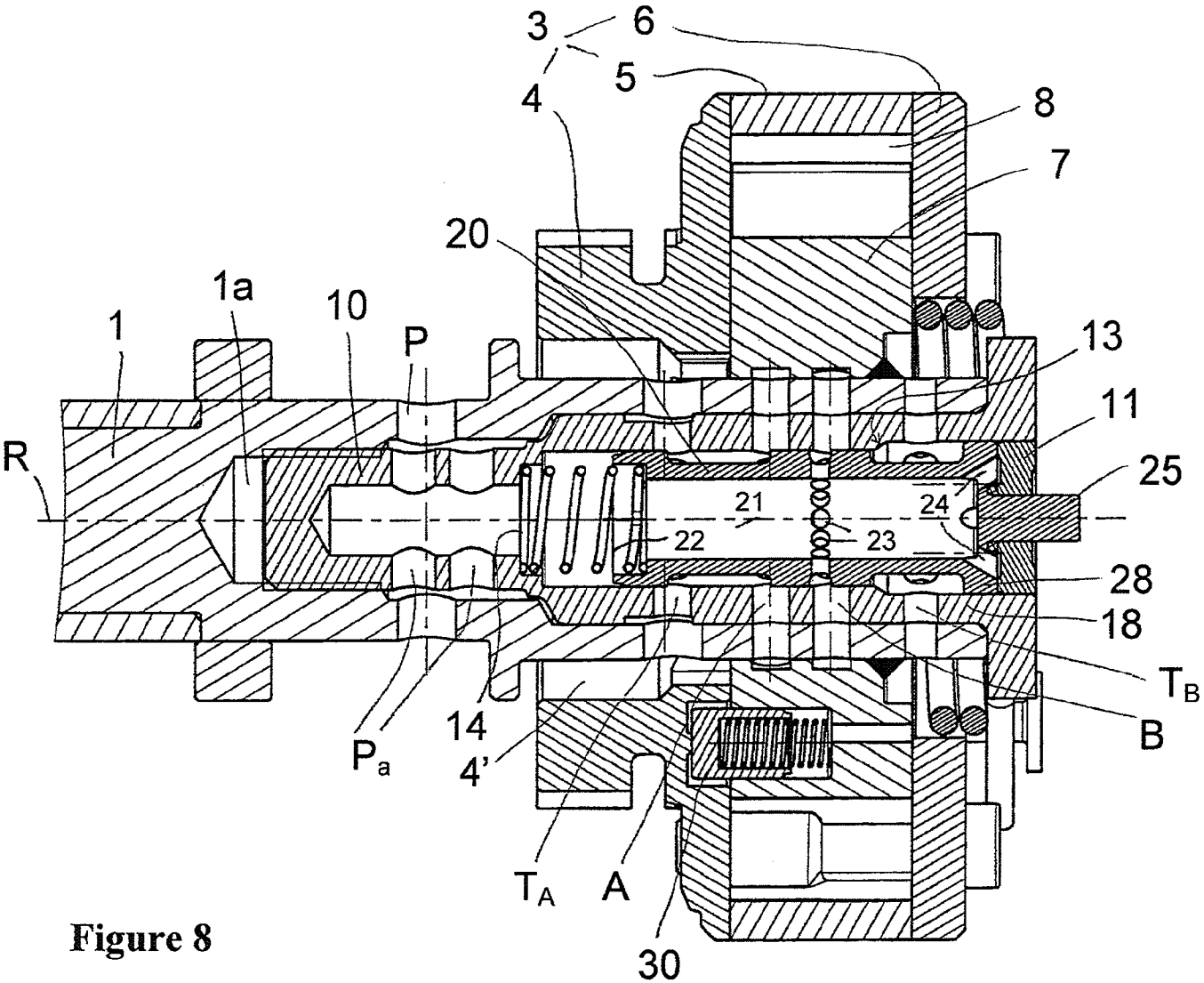
FIG. 8 a cam shaft phase setter of a fourth example embodiment.

FIG. 8 shows a cam shaft phase setter of a fourth example embodiment, likewise in a longitudinal section which includes the rotational axis R of the cam shaft 1. Unlike the other example embodiments, the fluid of the high-pressure side does not simply flow axially into the control valve but rather via a radial pressure port $P_r$. The valve housing 10 is closed at its axially inner axially facing end. The ports A to $T_B$ are formed as in the second example embodiment. The statements made with respect to the first example embodiment also otherwise apply to the fourth example embodiment.

LIST OF REFERENCE SIGNS

1 cam shaft
1*a* accommodating space
1*b* separating element
2 pivot bearing, engine housing
2*a* phase setter housing
2*b* cover
3 stator
drive wheel
4' feedback
4*a* feedback
5 impeller wheel
6 cover
7 rotor
7*a* feedback
8 pressure chamber
9 pressure chamber
10 valve housing
11 axially facing closure wall
12 screw connection
13 taper
14 spring unit
15 actuating unit
16 coil
17 anchor
18 widened housing portion
19 screw head
20 valve piston
21 hollow space
22 piston inlet
23 piston outlet
24 compensating feed
25 coupling member
26 recess
27 recess
28 widening, widened piston portion
29 -
30 latching element
31 securing element
A operating port
B operating port
P pressure port
$P_a$ axial housing inlet
$P_r$ radial housing inlet
R rotational axis, central axis
$T_A$ reservoir port
$T_B$ reservoir port

The invention claimed is:

1. A cam shaft phase setter for adjusting the rotational angular position of a cam shaft relative to a crankshaft of an internal combustion engine by means of a hydraulic fluid, said cam shaft phase setter comprising:

(a) a stator which can be rotary-driven by the crankshaft;

(b) a pressure chamber for the fluid;

(c) a rotor which is connected, rotationally fixed, to the cam shaft and coupled to the stator such that torque is transmitted and which can be adjusted in its rotational angle relative to the stator by introducing the fluid into the pressure chamber;

(d) a control valve comprising a valve housing and a valve piston;

(e) the valve housing comprising a housing inlet, an operating port to the pressure chamber and a reservoir port to a reservoir for the fluid and being connected, rotationally fixed, to the cam shaft or being formed by the cam shaft;

(f) the valve piston being axially adjustable back and forth in the valve housing between a first position and a second position and comprising a piston feed which is connected to the housing inlet and is connected to the operating port in the first position of the valve piston and separated from the operating port in the second position of the valve piston;

(g) an actuating unit, coupled to the valve piston, for axially adjusting the valve piston;

(h) and a feedback through which fluid which flows through the valve housing can be fed back into an engine housing of the internal combustion engine which rotatably mounts the cam shaft;

(i) wherein the cam shaft phase setter is configured such that the fluid flowing through the control valve flows back into the engine housing through one or more components of the cam shaft phase setter which rotate with the cam shaft, and (j) wherein the feedback extends outside of the valve housing axially through the rotor of the cam phase setter.

2. The cam shaft setter according to claim 1, wherein the feedback comprises a plurality of passages which are arranged in a distribution around the rotational axis of the rotor.

3. The cam shaft setter according to claim 1, wherein a continuative feedback, which is connected to the feedback of the rotor, extends in the stator.

4. The cam shaft setter according to claim 1, wherein a continuative feedback, which is connected to the feedback of the rotor, is formed by one or more bores in the stator or by one or more groove-shaped or fully circumferential inner widenings or is delimited jointly by the stator radially on the outside and by the cam shaft radially on the inside.

5. The cam shaft phase setter according to claim 1, wherein the feedback extends from the reservoir port to the engine housing through the cam shaft phase setter only.

6. The cam shaft phase setter according to claim 1, wherein the valve housing is or can be screwed to the cam shaft, and a screw head of the valve housing closes off the feedback for the fluid.

7. The cam shaft phase setter according to claim 1, wherein the actuating unit comprises an electromagnetic coil and an anchor which can be axially moved relative to the coil, the coil being connected, rotationally fixed, to the engine housing of the internal combustion engine, and wherein the valve piston can be rotated relative to the anchor.

8. The cam shaft phase setter according to claim 7, comprising a coupling member which extends axially between the valve piston and the anchor in order to transmit an axial actuating force of the actuating unit onto the valve piston.

9. The cam shaft phase setter according to claim 1, wherein a spring unit acts on the valve piston in the direction of the first position, and the actuating unit acts on the valve piston in the direction of the second position.

10. The cam shaft phase setter according to claim 1, wherein an additional pressure chamber for the fluid is provided; one of the pressure chambers acts in the direction of the cam shaft leading, and the other acts in the direction of the cam shaft trailing; the valve housing comprises an additional operating port, axially spaced from the operating port, in order to guide the fluid to the additional pressure chamber; and the piston feed is connected to the additional operating port in the second position of the valve piston and separated from the additional operating port in the first position of the valve piston.

11. The cam shaft phase setter according to claim 1, wherein the valve housing comprises an additional operating port and an additional reservoir port; the valve piston outlet is connected to the additional operating port in the second position of the valve piston and separated from the additional operating port in the first position of the valve piston; and the valve piston connects the additional operating port to the additional reservoir port in the first position of the valve piston.

12. The cam shaft phase setter according to claim 1, wherein the housing inlet leads axially into the valve housing on an axially facing side of the valve housing.

13. The cam shaft phase setter according to claim 1, wherein the valve piston comprises an axial hollow space and a piston inlet for introducing the fluid into the hollow space.

14. The cam shaft phase setter according to claim 13, wherein the piston inlet leads axially into the hollow space on an axially facing side of the valve piston.

15. The cam shaft phase setter according to claim 1, wherein the valve housing is inserted into an accommodating space of the cam shaft and is screwed to the cam shaft or axially secured by means of a securing device.

16. The cam shaft phase setter according to claim 1, wherein a closure disc which is fixedly joined to the valve housing forms an axially facing closure wall of the valve housing.

17. A cam shaft phase setter for adjusting the rotational angular position of a cam shaft relative to a crankshaft of an internal combustion engine by means of a hydraulic fluid, said cam shaft phase setter comprising:

(a) a stator which can be rotary-driven by the crankshaft;

(b) a pressure chamber for the fluid;

(c) a rotor which is connected, rotationally fixed, to the cam shaft and coupled to the stator such that torque is transmitted and which can be adjusted in its rotational angle relative to the stator by introducing the fluid into the pressure chamber;

(d) a control valve comprising a valve housing and a valve piston;

(e) the valve housing comprising a housing inlet, an operating port to the pressure chamber and a reservoir port to a reservoir for the fluid and being connected, rotationally fixed, to the cam shaft or being formed by the cam shaft;

(f) the valve piston being axially adjustable back and forth in the valve housing between a first position and a second position and comprising a piston feed which is connected to the housing inlet and is connected to the operating port in the first position of the valve piston and separated from the operating port in the second position of the valve piston;

(g) an actuating unit, coupled to the valve piston, for axially adjusting the valve piston;

(h) and a feedback through which fluid which flows through the valve housing can be fed back into an engine housing of the internal combustion engine which rotatably mounts the cam shaft;

(i) wherein the feedback extends from the reservoir port to the engine housing through the cam shaft phase setter only, and (j) wherein the feedback extends outside of the valve housing axially through the rotor of the cam shaft phase setter.

18. The cam shaft setter according to claim 17, wherein the feedback comprises a plurality of passages which are arranged in a distribution around the rotational axis of the rotor.

19. The cam shaft phase setter according to claim 17, wherein the reservoir port is connected to the feedback which extends within an arrangement which comprises the stator, the rotor, the control valve and the cam shaft and can be rotated together with the cam shaft, in order to guide the fluid back into the engine housing of the internal combustion engine.

20. The cam shaft phase setter according to claim 17, wherein the valve housing is or can be screwed to the cam shaft, and a screw head of the valve housing closes off the feedback for the fluid.

* * * * *